US005428926A

United States Patent [19]

Melfi

[11] Patent Number: 5,428,926

[45] Date of Patent: Jul. 4, 1995

[54] SERPENTINE NOISE BARRIER

[75] Inventor: Nicholas W. Melfi, Manlius, N.Y.

[73] Assignee: Concrete Pipe and Products Corp., East Syracuse, N.Y.

[21] Appl. No.: 31,338

[22] Filed: Mar. 15, 1993

[51] Int. Cl.[6] ..... F04H 17/14; F04B 7/16

[52] U.S. Cl. ..... 52/71; 52/293.3; 52/295; 52/247; 52/587.1

[58] Field of Search ..... 52/272, 293.3, 293.1, 52/281, 282.4, 295, 299, 93.1, 578, 586, 587.1, 468, 71; 256/73, 1, 13, 15, 16, 19

[56] References Cited

U.S. PATENT DOCUMENTS

| | | | |
|---|---|---|---|
| 2,264,290 | 12/1941 | Blain | 52/281 |
| 2,587,724 | 3/1952 | Henderson | 52/295 |
| 3,189,949 | 6/1965 | Hurkamp | 52/71 |
| 3,195,189 | 7/1965 | Villandry | 52/299 |
| 3,213,580 | 10/1965 | Mark | 52/292 |
| 3,216,163 | 11/1965 | Carew | 52/295 |
| 3,732,653 | 5/1973 | Pickett . | |
| 3,865,051 | 2/1975 | Johl et al. | 52/71 |
| 4,030,262 | 6/1977 | Dean | 52/583 |
| 4,111,401 | 9/1978 | Pickett . | |
| 4,138,947 | 2/1979 | Pickett . | |
| 4,214,411 | 7/1980 | Pickett . | |
| 4,296,584 | 10/1981 | Lempa, Jr. | 52/296 |
| 4,558,850 | 12/1985 | Melfi . | |
| 5,022,781 | 6/1991 | Smith | 256/73 |
| 5,134,815 | 8/1992 | Pickett . | |

FOREIGN PATENT DOCUMENTS 1679001 9/1991 U.S.S.R. .

*Primary Examiner*—Carl D. Friedman
*Assistant Examiner*—Winnie S. Yip
*Attorney, Agent, or Firm*—Harris Beach & Wilcox

[57] ABSTRACT

A serpentine noise barrier wall containing abutting concrete panels wherein the end panels of the wall are seated on concrete pads and supported in an upright position by angle irons. Adjacent panels are joined together at the shared joint region by connector plates that are mounted in recesses formed in the adjacent panels and are drawn tightly in place by threaded fasteners. Concrete footings are used to support the upper panels of two abutting panels where a pronounced change in grade occurs.

10 Claims, 3 Drawing Sheets

SERPENTINE NOISE BARRIER

BACKGROUND OF THE INVENTION

This invention relates to a noise barrier wall and, in particular, to a serpentine noise barrier wall.

A serpentine noise barrier wall is described in U.S. Pat. No. 4,558,850. This type of barrier wall is typically erected along roadways to isolate surrounding properties from vehicular noise and to prevent pedestrians and animals from straying onto the roadway. Typically, the serpentine wall is made up of pre-cast, concrete panels that are joined together at vertically-disposed, abutting joints to form a zig-zag like structure. The angular displacement between adjacent panels is dictated by expected wind loading, the height of the wall and, to some extent, by the topography of the terrain.

Serpentine barrier walls utilizing hinged joints are also described in U.S. Pat. Nos. 3,732,652 and 4,111,401. Here, the panels generally contain a rounded surface along one side edge and a circular groove along the opposing side edge. In assembly, the rounded surface of one panel is inserted into the circular groove of a second panel and the panels set at a desired angle within the degree of freedom afforded by the joint. The panels, once set in place, are locked at the desired angle using various types of devices such as cables and swivel pin assemblies. Although this type of hinged joint provides for a great deal of flexibility, the male and female sections making up the hinged joints are difficult to cast and can be easily fractured or broken during transportation, handling and erection of the panels.

The joints between the adjacent panels of some serpentine walls are oftentimes relatively weak and footings must be placed beneath each joint to help support the panels in assembly. Relatively long walls, therefore, require a large number of footings. These footings require a good deal of time and effort to prepare and thus increase the manufacturing erection costs.

SUMMARY OF THE INVENTION

It is therefore an object of the present invention to improve serpentine noise barrier walls.

It is a further object of the present invention to reduce the number of footings required to support a serpentine noise barrier wall without sacrificing wall strength.

A still further object of the present invention is to provide a high strength joint between adjacent panels of a serpentine noise barrier wall.

Another object of the present invention is to simplify the construction of a serpentine noise barrier wall.

Yet another object of the present invention is to reduce the amount of time required to erect a noise barrier wall.

These and other objects of the present invention are attained by a noise barrier wall employing pre-cast, concrete panels that are disposed of at predetermined angles to provide a serpentine structure. The two end panels of the wall are seated upon concrete pads and are supported in an upright position by opposed, anchored angle irons bolted to the panels. Adjacent panels are placed in abutting contact at desired angles along a common joint and are secured in place by metal connector plates that are bent to the joint angle. The connector plates are mounted in recesses formed in the adjacent panels and are drawn tightly against the panels by threaded fasteners. A footing is placed beneath the upper panel of a joint section only where a pronounced change in grade occurs.

BRIEF DESCRIPTION OF THE DRAWINGS

For a better understanding of these and other objects of the present invention, reference shall be made to the following detailed description of the invention which is to be read in association with the accompanying drawings, wherein.

DESCRIPTION OF THE INVENTION

Figure 1:
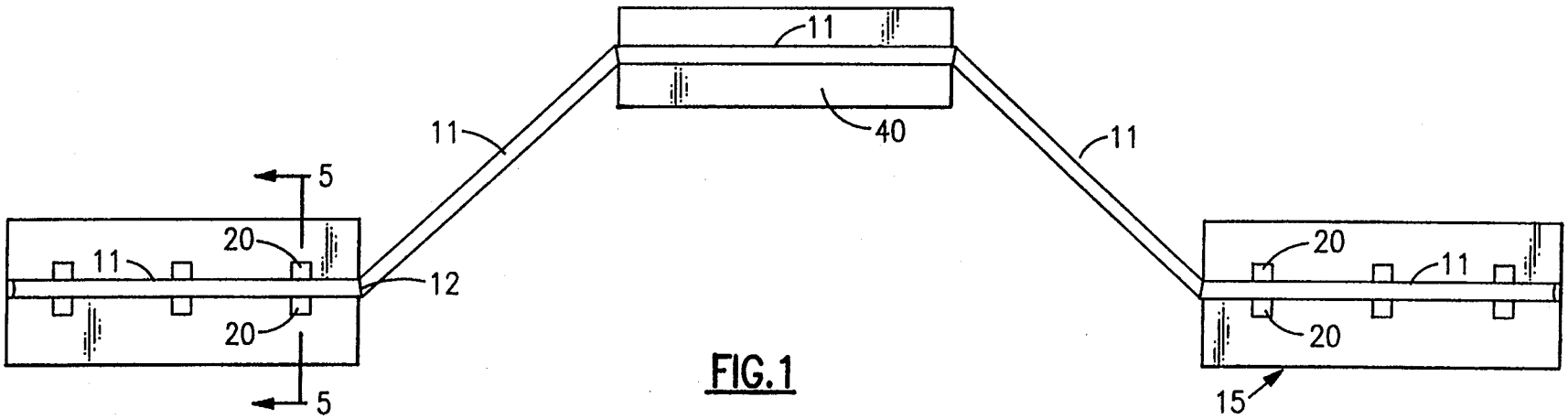
FIG. 1 is a top plan view of a concrete serpentine noise barrier wall embodying the teachings of the present invention.
Figure 2:
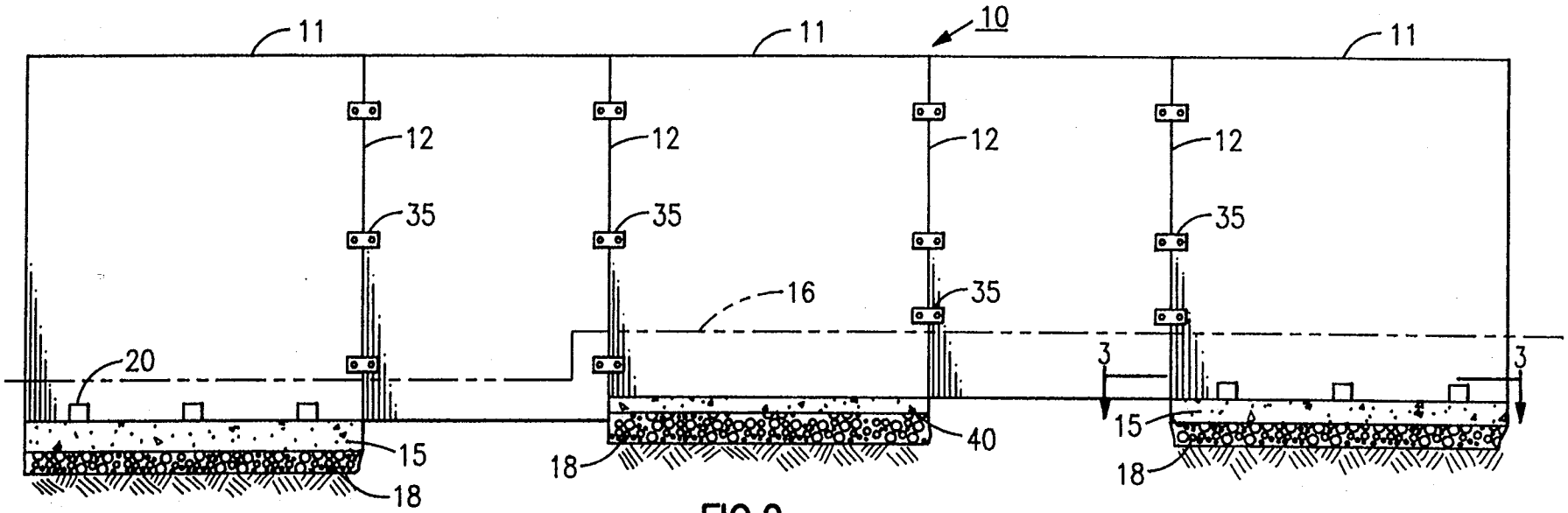
FIG. 2 is a front elevation of the noise barrier wall shown in FIG. 1 further illustrating a pronounced change in the grade of the terrain upon which the wall is situated.

A serpentine noise barrier wall, generally referenced 10, embodying the teachings of the present invention is shown in FIGS. 1 and 2. The barrier wall in the illustrated embodiment of the invention contains five separate panels 11—11, each of which is angularly-disposed from its neighbor. The panels are each preformed of reinforced concrete prior to erection and are brought to the erection site in a finished form. The angular joints 12 between adjacent panels are determined based on expected wind loads, the height of the panel and other known variables of consideration. Although the present wall contains five panels which are set at specific angles, it should be clear to one skilled in the art that a wall may contain any number of panel sets at various angles without departing from the teachings of the present invention.

As illustrated in FIG. 1, the flat, abutting end faces of adjacent panels form a tight, vertical joint between the panels that extends along the shared, vertical length between panels. The tight, flat joint prevents the panels from shifting or moving after erection even when the wall is subjected to relatively high wind loads, The flat end surfaces are easily cast and are not readily susceptible to breakage.

Figure 3:
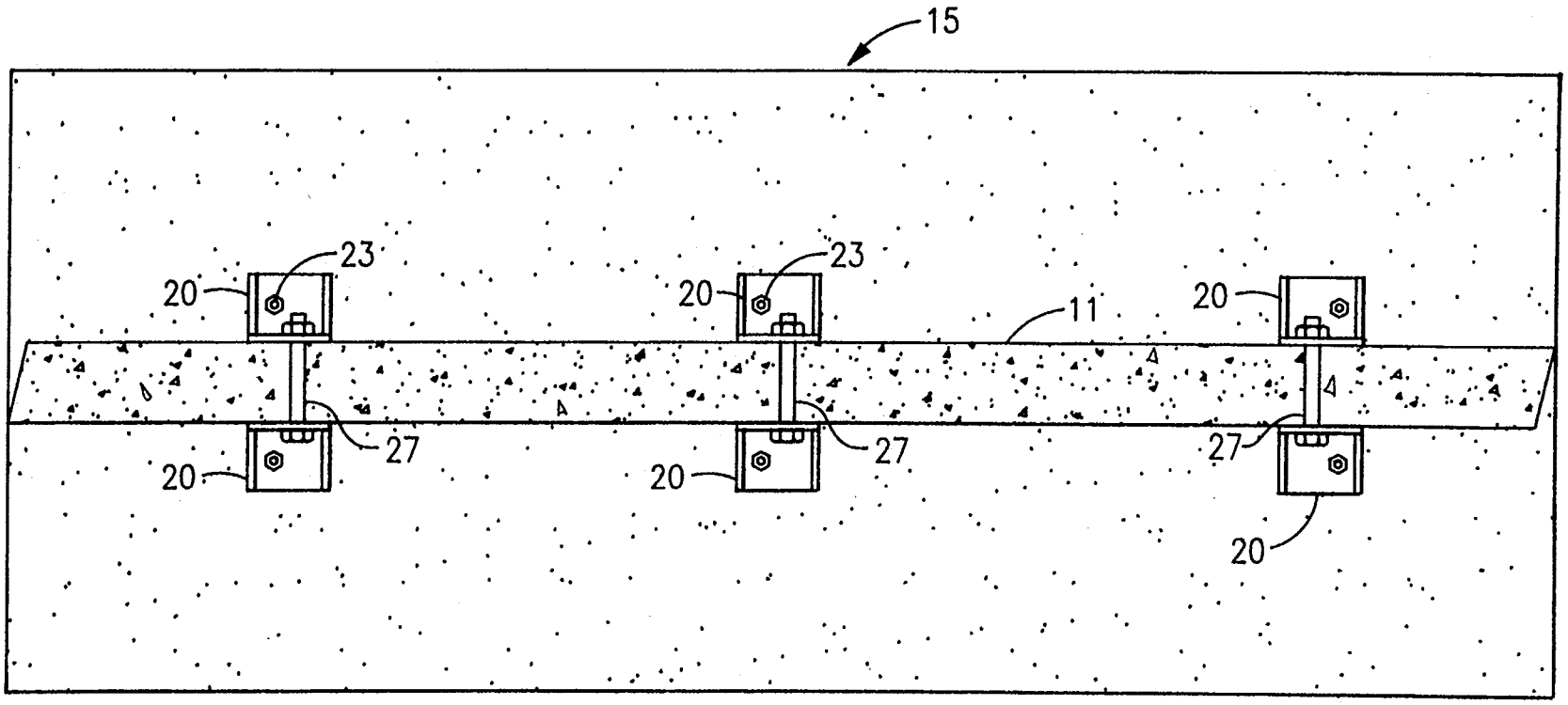
FIG. 3 is an enlarged section taken along lines 3—3 in FIG. 2.
Figure 5:
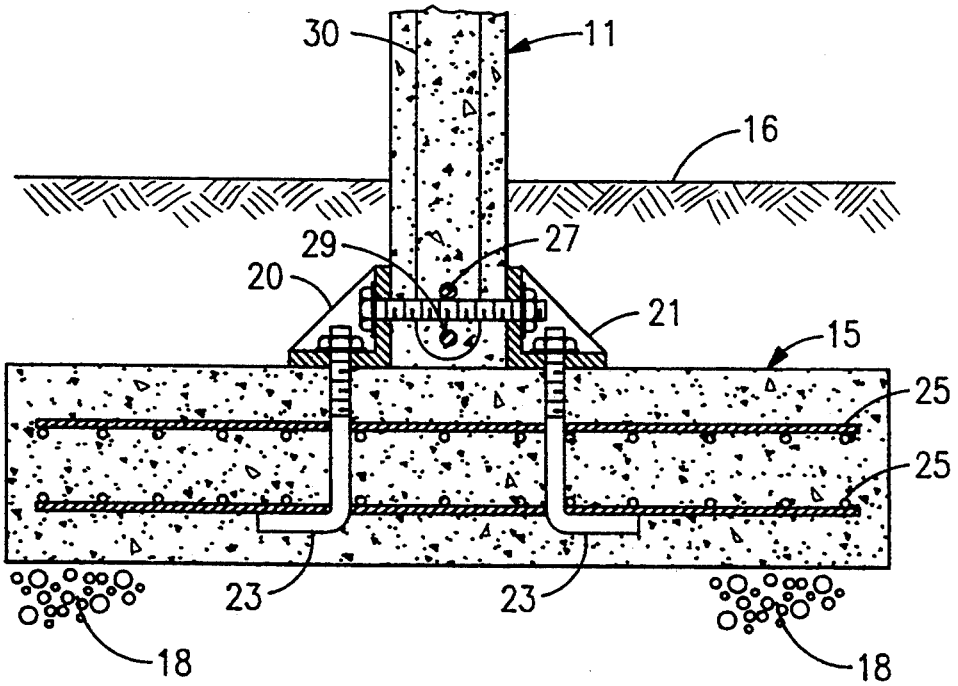
FIG. 5 is an enlarged section taken along lines 5—5 in FIG. 1.

The two end panels of the wall are each mounted upon a concrete pad 15 which is typically about one foot thick and set about one foot below the grade level 16. Each pad is seated upon about a foot of granular fill 18. As best seen in FIGS. 3 and 5, each end panel is further supported in an upright position between a coacting pair of angle irons 20. The angle irons are reinforced by gusset plates or stiffeners 23 and are secured to the underlying pad by means of J-shaped anchor bolts 23—23. Each pad is reinforced with metal mats having bars 25—25 running both laterally and longitudinally across the pad. The anchor bolts, in assembly, are looped about and joined to the mats, as by spot welding, to provide the anchor bolts with additional strength. Support bolts 27—27 are passed through the end panels and are secured to the opposed angle iron in each coacting pair. A horizontal reinforcing bar 29 is cast into the lower section of each end panel and is arranged to pass beneath the support bolts. A series of spaced-apart, hairpin-shaped reinforcing bars 30 are looped about the horizontal bar to again provide additional strength to the structure within the bolting region.

Figure 4:
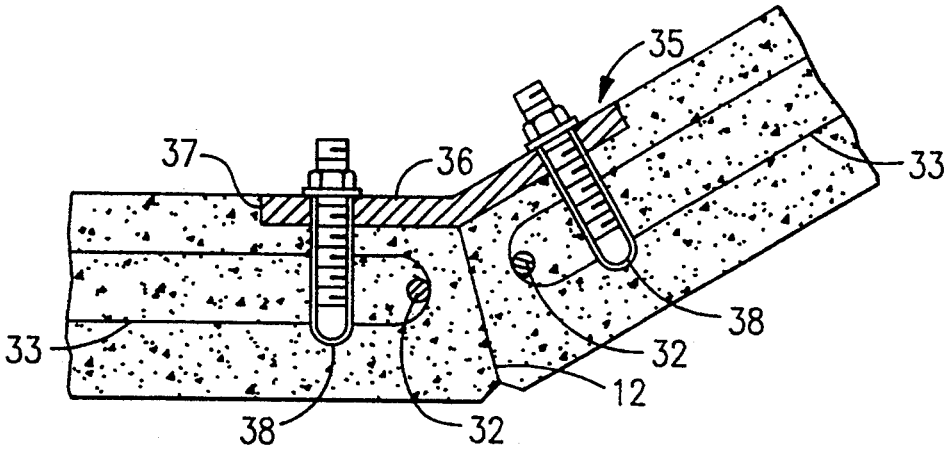
FIG. 4 an enlarged top sectional view taken through a joint section between two adjacent panels further showing a bent connector plate fastened to the panels.

FIG. 4 illustrates a typical joint 12 between adjacent panels 11—11. As explained above, the flat end surfaces of the abutting panels are pre-cast to the desired configuration so that when the panels are brought together at the time of erection, the abutting end walls form a tight, vertically-disposed joint. Each panel is reinforced by vertical rods 32—32 and horizontally-disposed, hairpin-shaped, reinforcing bars 33—33. A plurality of connector units 35—35 are spaced apart along each joint. Each connector unit includes a connector plate 36 that is seated in a recess 37 formed in the abutting panels. Threaded anchor inserts 38—38 are cast into the panels behind each recess and are adapted to receive threaded fasteners that are passed through holes provided in the connector plates. The connector plates are bent to conform to the joint angle so that when the fasteners are threaded into the inserts, the connector plates are drawn tightly into the recesses.

Hairpin-shaped, reinforcing bars 33—33 are positioned both above and below each insert in close proximity therewith. The hairpin-shaped, reinforcing bars are looped about the last vertical bar 32 in each panel that is positioned between the inserts and the end wall of each panel. Here again, the reinforcing bars are strategically positioned to not only reinforce the panel but to also provide additional strength in the connector plate regions.

Although the connector plate is shown located on the inside of each joint, it should be clear that the assemblies can be similarly located on the outside of each joint or on both sides of the joints without departing from the teaching of the present invention.

With further reference to FIGS. 1 and 2, a concrete footing 40 is placed beneath the upper panel of a joint which is situated near or at a pronounced change in grade. The footing is typically about 6" thick and may be seated upon a bed of granular fill. As should be evident from the disclosure above, the present serpentine noise barrier wall is basically supported by the two end panels with a minimum amount of additional support being provided by smaller footings where a change in the grade occurs requiring the lower panel to be higher than the upper panel.

While this invention has been explained with reference to the structure disclosed herein, it is not confined to the details set forth and this application is intended to cover any modifications and changes as may come within the scope of the following claims.

What is claimed is:

1. A concrete noise barrier comprising:

a series of pre-formed concrete panels being abutted together to form vertically-disposed, angle joints between adjacent panels, said series of pre-formed concrete panels including an intermediate segment of three consecutive angularly-disposed panels having a middle panel and two angularly disposed panels, said intermediate segment being contained between two end panels to form a serpentine wall with said end panels being substantially collinear and the middle panel of said intermediate segment being substantially parallel to the end panels;

a concrete pad for mountably securing each of said end panels in an upright position;

a plurality of raised support members anchored in each pad being arranged in pairs with opposed members, each opposed member of each pair being located on opposite sides of one of said end panels;

bolting means passing through each of said end panels for securing the end panel in an upright position between each pair of opposed support members;

a plurality of vertically-spaced, joint connector plates each passing horizontally across one of said vertically-disposed, angle joints between adjacent panels, each connector plate being bent at the angle of its respective joint and providing sufficient support to rigidly maintain the panels of said intermediate segment panels without being supported by said raised support members relative to the end panel pads; and fastening means for securing each connector plate to the adjacent panels forming a respective vertically-disposed, angle joint so that the load of each panel of said intermediate segment of three consecutive angularly-disposed panels is transferred to said concrete pads through said end panels.

2. The noise barrier of claim 1 wherein said connector plates are mounted in recesses formed in adjacent surfaces of consecutive panels.

3. The noise barrier of claim 1 wherein each concrete end pad is reinforced with metal rods embedded in the concrete and the support members are anchored to each pad by anchor bolts secured to said reinforcing rods.

4. The noise barrier of claim 1 wherein each panel contains recessed threaded inserts for receiving threaded fastening means for securing the connector plates to the panels.

5. The noise barrier of claim 1 wherein said raised support members are angle irons each of which contains a horizontal leg and a vertical leg and further including stiffening plates welded between the legs.

6. The noise barrier of claim 4 wherein each panel is reinforced internally with metal bars and wherein the bars are arranged to pass above and below each insert.

7. The noise barrier of claim 1 wherein said connector plates are mounted on an inner side of each angularly-disposed joint.

8. The noise barrier of claim 1 wherein said connector plates are mounted on an outside of each angularly-disposed joint.

9. The noise barrier of claim 1 wherein said connector plates are mounted both on an inner outer sides and outside of each angularly-disposed joint.

10. The noise barrier of claim 1 wherein when said serpentine wall is situated on terrain where a pronounced change in the grade occurs such that said middle panel of said intermediate segment is positioned higher relative to either of the other two panels of the segment, the wall further includes a concrete footing placed under the middle panel adjacent the relatively lower panel of the segment.

* * * * *